US005085237A

United States Patent [19]

Milligan

[11] Patent Number: 5,085,237

[45] Date of Patent: Feb. 4, 1992

[54] ASBESTOS REMOVAL EQUIPMENT

[76] Inventor: Charles J. Milligan, 2635 Summit, St. Louis, Mo. 63114

[21] Appl. No.: 392,372

[22] Filed: Aug. 10, 1989

[51] Int. Cl.[5] ..... B08B 3/02

[52] U.S. Cl. ..... 134/104.2; 134/182; 134/200; 312/1; 239/271

[58] Field of Search ..... 134/200, 104.2, 172, 134/182; 239/271; 312/1

[56] References Cited

U.S. PATENT DOCUMENTS

| | | | |
|---|---|---|---|
| 2,018,003 | 10/1935 | Axtell | 47/49 |
| 2,246,797 | 6/1941 | Geddes | 239/271 |
| 2,850,992 | 9/1958 | Hooper et al. | 111/7 |
| 2,902,953 | 9/1959 | Young . | |
| 3,091,197 | 5/1963 | Henry | 111/7 |
| 3,593,728 | 7/1971 | Sauer | 134/200 |
| 3,762,171 | 10/1973 | Bjorheim | 61/36 |
| 4,106,701 | 8/1978 | Siefken | 239/271 |
| 4,169,420 | 10/1979 | Kresge, Sr. | 111/7 |
| 4,401,636 | 8/1983 | Flowers | 423/327 |
| 4,453,460 | 6/1984 | Rabe et al. | 100/73 |
| 4,623,186 | 11/1986 | Chavarria | 134/200 |
| 4,625,808 | 12/1986 | Halfpenny | 239/271 X |
| 4,626,291 | 12/1986 | Natale | 372/1 |
| 4,768,534 | 9/1988 | Anderson | 134/200 X |
| 4,783,129 | 11/1988 | Jacobson | 312/1 |
| 4,842,347 | 6/1969 | Jacobson | 312/1 |

*Primary Examiner*—Frankie L. Stinson

*Attorney, Agent, or Firm*—Cohn, Powell & Hind

[57] ABSTRACT

Apparatus (1) for removing asbestos insulation. A pipe (7) delivers a fluid such as a surfactant to tines (13) which are attached to the pipe. The tines have a tapered end (17) for puncturing the covering (C) over the asbestos and the tines penetrate partially through the thickness of asbestos. Fluid discharged through the tines saturate the asbestos so it can be removed.

11 Claims, 1 Drawing Sheet

ASBESTOS REMOVAL EQUIPMENT

BACKGROUND OF THE INVENTION

This invention relates to insulation removal and more particularly, to apparatus for removing asbestos from around pipes, boilers and the like.

As is generally well known, asbestos was for years used as an insulating material in schools and other public buildings, homes, offices and on ships. Typically, the asbestos was wrapped around boilers or overhead pipes. A layer of cheesecloth was then placed over the asbestos and lacquered. The result was an asbestos wrapped pipe with a hardened shell over the asbestos.

Now that medical science has demonstrated the hazards of asbestos, on-going program are in place, nationwide, to remove and dispose of this material. These programs are arduous and expensive because of the danger of releasing airborne asbestos fibers. Inhalation of even a few of these fibers can ultimately result in a person developing asbestosis, a fatal disease.

The common method employed to remove asbestos is to slit the lacquered coating in several places with a knife and then saturate the underlying asbestos with water sprayed on the openings. Wetting has the advantage of preventing asbestos fibers from being released to the atmosphere.

While effective, the current method is time consuming and thus expensive.

The present method overcomes these problems in a manner not revealed by the known prior art.

SUMMARY OF THE INVENTION

The present invention provides apparatus for the removal of asbestos which is both quicker and cheaper than the current method.

It is an aspect of this invention to provide apparatus by which relatively short or relatively lengthy sections of asbestos insulation can be quickly and easily removed.

It is another aspect of the invention to remove such asbestos without having the slit the wrapping since slitting the wrapping which occurs prior to the wetting may cause asbestos fibers to be released to the atmosphere. It is yet another aspect of the invention to provide apparatus by which a surfactant is injected into the asbestos to wet the asbestos and permit its removal.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figures 1, 2, 3, 4, 5, 6:
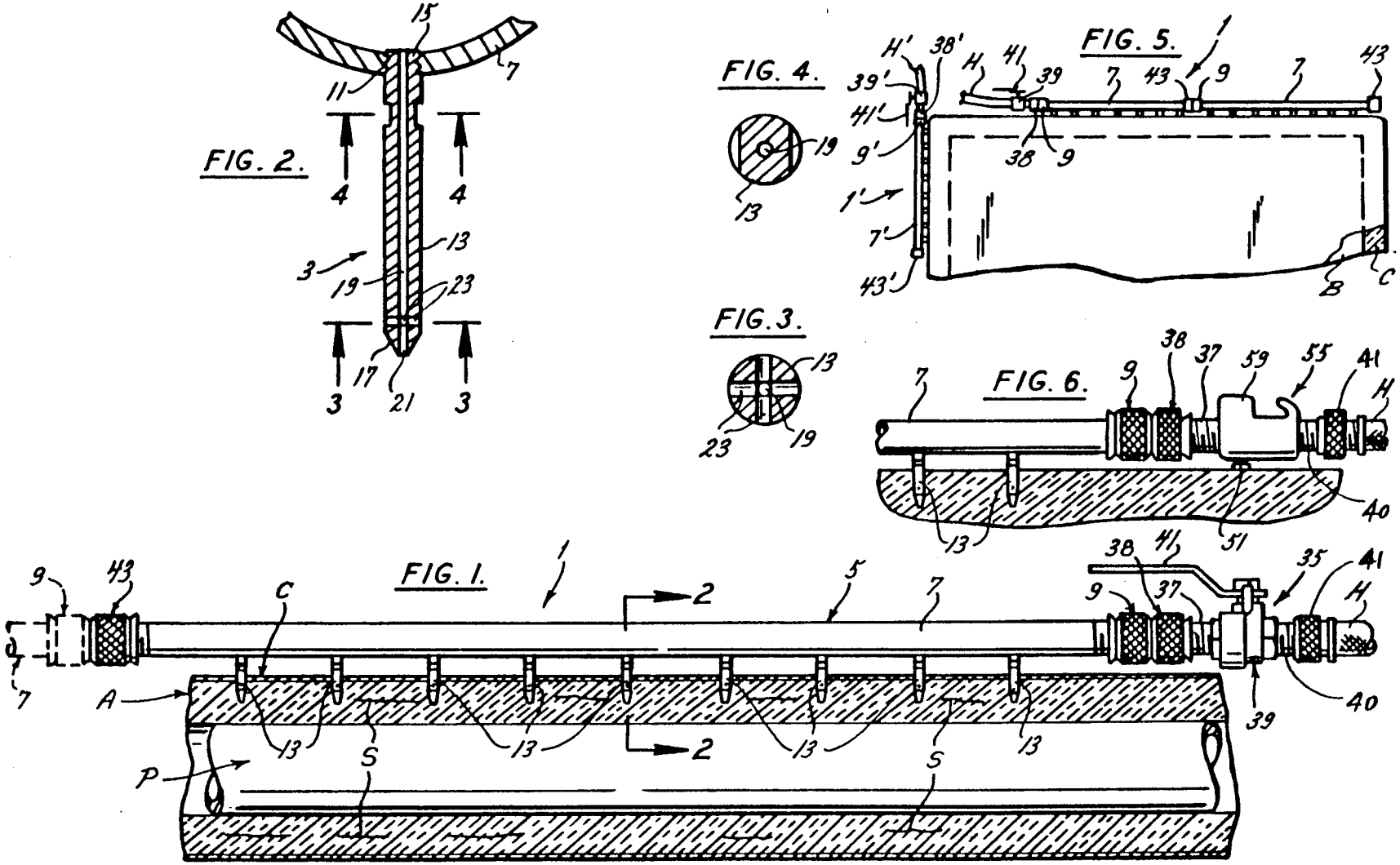
FIG. 1 is an elevational view, partly in section, of asbestos removal apparatus of the present invention.
FIG. 2 is a fragmentary sectional view taken along line 2—2 of FIG. 1.
FIGS. 3 and 4 are sectional views taken along lines 3—3 and 4—4 respectively in FIG. 2.
FIG. 5 is an elevational view illustrating use of multiple apparatus simultaneously for removing asbestos insulation from around a large appliance.
FIG. 6 is a fragmentary elevational view of the apparatus illustrating a modified apparatus.

Referring to the drawing by reference numerals and first to FIG. 1, a pipe P is wrapped in an asbestos insulation A. The asbestos is covered with a cheesecloth C and a lacquer is applied to the cheesecloth to harden it. In the past, to remove insulation, slits S were made in the cheesecloth wrapping and water was sprayed on the asbestos, through the slits, until the asbestos was saturated. (Asbetos will absorb up to 100% of its weight in water.) Once saturated, the asbestos is removed for disposal. While effective, this removal method had drawbacks. First, during the slitting, it is possible for asbestos fibers to be released to the atmosphere. Second, the operation is messy in that hosing water onto the wrapping means a lot of excess water spills onto the floor or other areas.

The apparatus of the present invention is indicated generally by numeral 1 in FIG. 1 and is for removing asbestos from pipes, boilers and the like in a simple and clean manner.

Apparatus 1 includes a wetting means 3 and a fluid delivery means 5. The fluid delivery means comprises a pipe 7 having a quick disconnect plug fitting 9 at one end for connecting the pipe to a fluid source (not shown). Pipe 7 which may, for example, be from six feet (6') to twenty feet (20') long, has a series of threaded openings 11 regularly spaced along its length as shown in FIG. 2. At its opposite end the pipe 7 has a femal end quick disconnect 43 with auto shut-off at the other end so that additional lengths of pipe 7 can be connected in series.

Wetting means 3 comprises tines or nozzles 13 which are adapted to fit in the openings 11. Again, as shown in FIG. 2, a tine 13 is tubular with a threaded upper end 14 sized to be screwed in an opening 11 and a tapered lower end 17 for puncturing the wrapping around the asbestos insulation. Each tine has a longitudinal bore 19 by which fluid such as a surfactant is discharged from pipe 7 to the asbestos through an opening 21 in the tine. Each tine further has at least one cross bore 23 for discharging fluid to saturate the asbestos.

Apparatus 1 includes a valve means 35 for regulating fluid flow through pipe 7. Valve means 35 includes a pipe section 37 having an end coupling 38, similar to coupling 43 and connectible to coupling 9; and a pipe section 40 connectible to the adaptor 41 at the end of a hose H. A manually operable valve 39 is fitted between said pipe sections 37 and 37' and the valve has a handle 41 for an operator to adjust the amount of fluid flowing through pipe 7.

FIG. 6 shows a modified apparatus in which, in lieu of a handle operated valve means 35 a push button valve means 55 is utilized. A push button operated valve 59 is fitted between said pipe section 37 and 40 and the valve has a spring loaded push button 51 which is depressed by pushing down on the apparatus. This opens the valve which remains open due to the weight of the apparatus and the friction from the tines inserted into the asbestos.

It will be understood that more than one element of the invention can be used simultaneously. For example, in FIG. 5, a boiler B, which can be a large unit covered with asbestos insulation, has one element of the apparatus 1 positioned on its top; and a second element 1' of the apparatus positioned on one of its sides. Appropriate hoses (H and H') may be connected to a manifold (not shown) or otherwise attached to a fluid source so fluid can be simultaneously directed to asbestos on both the tops and sides of the boiler. It will be understood that the two elements of the apparatus shown in the figure are exemplary only and, if practical, three or more elements could be used.

In view of the above it will be seen that various aspects and features of the invention are achieved and other advantageous results attained. While a preferred embodiment of the invention has been shown and described, it will be clear to those skilled in the art that changes and modifications may be made therein without departing from the invention in its broader aspects.

I claim as my invention:

1. Apparatus for removing an asbestos type insulation material from around appliances, and pipes the insulation being covered by a hardened shell, the apparatus comprising: wetting means including at least one fluid injector adapted for puncturing the hardened cover, for penetrating at least partially through the thickness of the insulation and for injecting a wetting solution into the insulation thus penetrated, fluid delivery means for delivering a fluid such as a surfactant to the wetting means, to be discharged into the insulation to saturate the insulation so it can be removed.

2. Apparatus for removing an asbestos insulation material from around appliances, and pipes the asbestos being covered by a hardened shell, the apparatus comprising wetting means including a plurality of injectors each adapted for puncturing the hardened cover for penetrating at least partially through the thickness of the asbestos, and for discharging a wetting solution into the asbestos thus penetrated, fluid delivered means for delivering a fluid such as a surfactant to the wetting means, the wetting means discharging the fluid to be injected into the asbestos to saturate the asbestos so it can be removed.

3. The apparatus of claim 1 wherein the fluid delivery means comprises a first length of pipe having a fitting at one end for connection to a fluid source.

4. The apparatus of claim 3 wherein the pipe has a series of openings regularly spaced along its length and the wetting means comprises tines adapted to fit into the openings.

5. The apparatus of claim 4 wherein each tine has a longitudinal bore for transmitting the fluid from the pipe to the asbestos.

6. The apparatus of claim 3 further including valve means for regulating the flow of fluid through the pipe.

7. The apparatus of claim 6 wherein the valve means includes a second length of pipe connected to one end of the first said length of pipe, the second said length of pipe having a manually operable valve.

8. The apparatus of claim 7 wherein the valve means includes a handle for adjusting the position of the valve.

9. The apparatus of claim 6 wherein the valve means includes a second length of pipe connected to one end of the first said length of pipe, the second said length of pipe having a push-button operated valve.

10. The apparatus of claim 3 wherein the other end of the pipe has a fitting connecting the pipe to similar pipes thereby to increase the overall length of the apparatus.

11. The apparatus of claim 2 wherein each tine also has at least one cross bore further transmitting fluid from the pipe to the asbestos.

* * * * *